US010016081B2

(12) United States Patent
Iliev

(10) Patent No.: US 10,016,081 B2
(45) Date of Patent: Jul. 10, 2018

(54) EATING UTENSIL

(71) Applicant: Ivaylo Iliev, Sofia (BG)

(72) Inventor: Ivaylo Iliev, Sofia (BG)

( * ) Notice: Subject to any disclaimer, the term of this patent is extended or adjusted under 35 U.S.C. 154(b) by 0 days.

(21) Appl. No.: 14/905,958

(22) PCT Filed: Jul. 15, 2014

(86) PCT No.: PCT/BG2014/000028

§ 371 (c)(1),
(2) Date: Jan. 18, 2016

(87) PCT Pub. No.: WO2015/006837

PCT Pub. Date: Jan. 22, 2015

(65) Prior Publication Data

US 2016/0166095 A1 Jun. 16, 2016

(30) Foreign Application Priority Data

Jul. 18, 2013 (BG) ..... 002589

(51) Int. Cl.
*A47G 21/08* (2006.01)
*A47G 21/02* (2006.01)

(52) U.S. Cl.
CPC ..... *A47G 21/08* (2013.01); *A47G 21/023* (2013.01)

(58) Field of Classification Search
CPC ..... A47G 21/08; A47G 21/023
USPC ..... 30/148
See application file for complete search history.

(56) References Cited

U.S. PATENT DOCUMENTS 331,177 A * 11/1885 Albin ..... A47G 21/08 30/148
843,953 A * 2/1907 Laramy ..... A47G 21/02 30/147
1,294,031 A * 2/1919 Bigelow ..... A47G 21/08 30/148
1,553,006 A * 9/1925 Sallac ..... A47G 21/023 30/148
2,322,503 A * 6/1943 Bowman ..... A47G 21/023 30/148
2,473,288 A * 6/1949 McNeill ..... A47G 21/02 30/147

(Continued)

FOREIGN PATENT DOCUMENTS

DE 10 2006 059268 A1 * 6/2008
DE 10-2006-059268 A1 6/2008
FR 524 805 A 9/1921

*Primary Examiner* — Hwei C Payer
(74) *Attorney, Agent, or Firm* — Steven M. War, Esq.; McNeely, Hare & War LLP

(57) ABSTRACT

The invention relates to an eating utensil which combines the capabilities of a fork, characterized by function for spearing the food and of a knife characterized by function for cutting the food and can be used by handicapped and people with decreased functional ability of one of their upper limbs. The eating utensil consists of a handle (1) and a head (5) with formed static spearing tines (9) and mounted rotating cutting tines (8') and (8"). The handle (1) has a cavity in which a semi-automatic reciprocal spring mechanism (2) is inbuilt. In outer circumferential surface of the handle (1) are formed slots (1') and sliders with ergonomic shape are placed in them for right (3') or for left (3") handed use.

3 Claims, 1 Drawing Sheet

(56) References Cited

U.S. PATENT DOCUMENTS

| | | | | | |
|---|---|---|---|---|---|
| 4,182,032 | A * | 1/1980 | Newport | A47G 21/023 | 30/137 |
| 4,535,538 | A * | 8/1985 | Nelson | A47G 21/02 | 30/147 |
| 4,984,367 | A * | 1/1991 | Albanese | A47G 21/02 | 30/147 |
| 5,542,181 | A * | 8/1996 | Gaylord | A47G 21/02 | 30/148 |
| 9,265,372 | B2 * | 2/2016 | Stewart-Stand | A47G 21/02 | |
| 2016/0166095 | A1 * | 6/2016 | Iliev | A47G 21/023 | 30/148 |

* cited by examiner

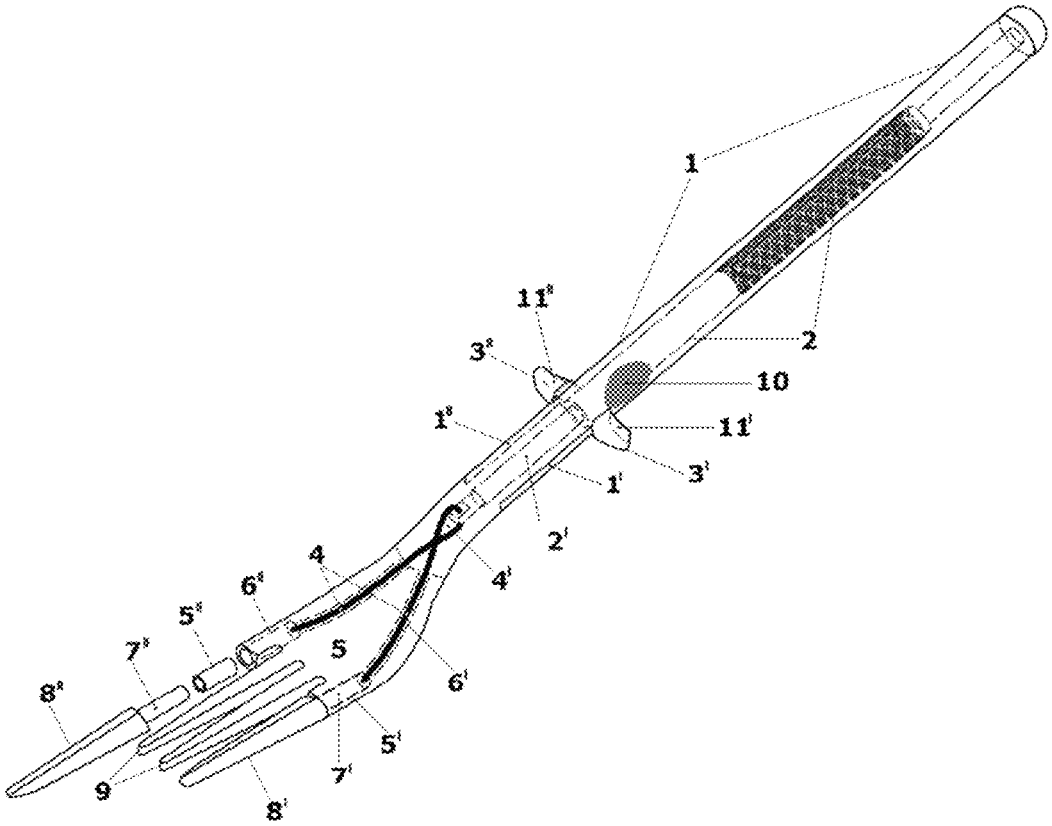
1
2
10
11'
3'
1'
2'
4'
6'
5'
7'
8'
9
11"
3"
1"
4
6"
5"
7"
8"
5

EATING UTENSIL

FIELD OF THE INVENTION

The invention relates to an eating utensil, which can be used by the handicapped and by people with decreased functional ability of one of their upper limbs or by normal people.

STATE OF THE ART

The well-known eating utensil (fork) includes a handle and a head with shaped static tines for spearing the food. The number of these static tines is usually 2, 3 or 4. The two endmost tines are rounded on their outer sides so when positioning the utensil laterally, even after applying significant efforts the soft food is torn to pieces but hardly cut precisely. Due to this, another utensil is needed—a knife—for cutting up the food to pieces. These two utensils engage both hands of a human and for this reason they are of little use for the handicapped and for people with decreased functional ability of one of their upper limbs.

TECHNICAL ESSENCE

The major objective of the invention is to develop an eating utensil which may be used with one hand only and will perform the functions of both a fork and a knife, and can be adapted for use by the disabled and by people with decreased functional ability of one of their upper limbs.

The task is solved with the creation of an eating utensil which is composed of handle and head with middle static tines as the two endmost tines can perform rotational motion and their inner side facing the middle static tines is shaped as blade.

According to the goal of the invention, in the cavity of the handle is inbuilt a semi-automatic reciprocating spring mechanism. In outer circumferential surface of the handle are formed slots with mounted sliders on which is located the pushing surface of the reciprocating spring mechanism. The rotating part of the mechanism inside the handle is connected to a transmission, inbuilt into the handle and head of the utensil. The transmission consists of a monolith flexible shaft bent in the middle making a turn and twisted at 90 degree relative to the bending plane, thus forming a loop which is placed into handle's neck and two active ends placed into holes made all along the head. The holes at frontal side of the head contain bearing shafts, connected to the active ends of the flexible shaft. The bearing shafts hold the cutting tines which can rotate bi-directionally to 180 degree. The inner longitudinal sides of these tines are shaped as blade.

When the utensil is not in use, the sharpened sides of the cutting tines are turned to the middle static tines. It is possible the cutting tines to be fixed to the root of the head via bearing shafts in addition with wedging bushings.

The eating utensil combines the capabilities of a fork characterized by function for spearing the food and of a knife characterized by function for cutting the food. This makes it usable by people with disabilities and with a decreased functional ability of one of their upper limbs. Thanks to the ergonomic shape of the handle and the two side sliders, the eating utensil can be used by both the left and the right hand.

DESCRIPTION OF THE ATTACHED FIGURES

FIG. 1 shows an axonometric view of the eating utensil.

EXAMPLES

According to FIG. 1, the utensil consists of a handle (1) and a head (5) with shaped at the middle static tines (9). The handle (1) has a cavity in which a semi-automatic reciprocating spring mechanism (2) is inbuilt. In outer circumferential surface of the handle (1) are formed slots (1') and (1") with ergonomically shaped sliders (3', 3") placed in them for use with right or left hand. When the utensil is positioned laterally for cutting up the food the place of the slider (3', 3") coincides with the abutment surface (10) of the index finger of the user over the handle (1). On slider (3', 3") is the pushing surface (11', 11") of the reciprocating spring mechanism (2) which takes the pressure force from the user's index finger and inputs it as translational motion into the mechanism (2). Because of its specific construction, the mechanism (2) transforms the translational motion into a rotational motion with increased moment of force according to the relation ratio between acceleration of the translational momentum and momentum of force of the rotational movement. The rotating part (2') of the mechanism (2) inside the handle (1) is connected to a transmission (4) inbuilt into the handle (1) and holes (6') and (6") made in head (5) of the utensil. The transmission (4) consists of a monolith flexible shaft, bent in the middle, thus forming a loop (4') inside handle's neck. Generated rotational movement from the mechanism (2) is projected over the loop (4'). The difference between the radius of the loop (4') and the radius of the flexible shaft (4) increases the torque of the rotational movement additionally. The rotational movement of the loop (4') at 180 degree is transmitted without any losses of angular velocity to the two active ends of the transmission (4) placed in holes (6') and (6"). The active ends of the transmission (4) are in a permanent connection with the bearing shafts (7') and (7") which are monolith part of rotating cutting tines (8') and (8") with longitudinal inner side shaped as blade. The bearing shafts (7') and (7") are inbuilt in holes (6') and (6") at frontal side of the head (5) via wedging bushings (5') and (5") which protects the holes (6') and (6") from fluids and ensures low friction during the rotational motion of cutting tines (8') and (8").

APPLICATION OF THE INVENTION

When the utensil is positioned laterally for cutting up of food position of the user's index finger coincides with one of the sliders (3') or (3") depending on whether left or right hand is used. The pressure force of the finger in the attempt to cut food causes the slider (3') or (3") to move down along axis of the handle (1) and triggers the reciprocating spring mechanism (2) which transforms the translational motion of the slider (3') or (3") into a rotational one. The rotational movement from mechanism (2) is transmitted via the flexible transmission (4) to the bearing shafts (7') and (7") which cause the cutting tines (8') and (8") to rotate to 180 degree. To guarantee safety, when the utensil is positioned for spearing or lifting food, the mechanism (2) could not be triggered and the cutting edges of the rotating cutting tines (8') and (8") are directed internally towards the middle static tines (9) on the head (5) of the utensil. When turning their cutting profiles to the outer side of the utensil, they stay in this position until the cutting is over. After cutting the food, and after the pressure force of the user's index finger from the slider (3') or (3") is released, the reciprocating spring mechanism (2) returns the cutting tines (8') and (8") to its initial safe position (with blades directed internally), thus insuring the safe use of the utensil by the user.

The invention claimed is:

1. An eating utensil which includes a handle (1) and a head (5), characterized in that the handle (1) has a cavity in which a mechanism (2) is inbuilt and an outer circumferential surface of the handle (1) has slots (1', 1") for sliders (3', 3"), where the location of the sliders on the handle (1) is adjacent to an abutment surface (10) for an index finger of a user of the utensil in a lateral position of the handle, and on said sliders is a pushing surface (11', 11") for the mechanism (2), a rotating part (2') of the mechanism (2) is attached to a transmission (4) inbuilt into the head (5), the transmission (4) consists of a monolith flexible shaft, bent in its middle, forming a loop (4') inside a neck of the handle and is connected with the rotating part (2') of the mechanism (2), two active ends of the transmission (4) are inbuilt inside holes (6', 6") of the head (5) and are connected with bearing shafts (7', 7") which are monolith part of rotating cutting tines (8', 8") mounted into a frontal side of the head (5) in the holes (6', 6") via wedging bushings (5', 5") which ensure bi-directional rotation of the rotating cutting tines (8', 8") with their longitudinal internal sides shaped for cutting, facing middle static tines (9) of the head (5) at an initial position.

2. An eating utensil, according to claim 1, characterized in that the rotating cutting tines (8', 8") are mounted into the frontal side of the head (5) via the bearing shafts (7', 7").

3. An eating utensil, characterized in that it has a handle (1) in which a mechanism (2) is inbuilt and the handle (1) has holes or slots (1', 1") for buttons or sliders (3', 3"), the location of said buttons or sliders (3', 3") is adjacent to an index finger abutment surface (10) on the handle (1) when the utensil is held in a lateral position of the handle by a user, on the buttons or sliders (3', 3") is located a mechanism pushing surface (11', 11") which takes pressure from an index finger and thus an incoming driving force in a form of a linear motion is applied into the mechanism (2) that by means of a rotating part (2') outputs it as a rotary motion, the rotating part (2') transmits a rotary motion to a flexible shaft (4) inbuilt inside holes (6', 6") made along the entire length of a wide common root-base (5), the flexible shaft (4) transmits the rotary motion to bearing shafts (7', 7") which are monolith part of rotating cutting tines (8', 8") that have one longitudinal side shaped as a blade, the cutting tines (8', 8") are mounted into a frontal side of the common root-base (5) by means of wedging bushings (5', 5"), in such a way that the cutting tines (8', 8") can perform bi-directional rotation.

* * * * *